US006971458B2

(12) United States Patent
Kriesels et al.

(10) Patent No.: US 6,971,458 B2
(45) Date of Patent: Dec. 6, 2005

(54) DRILL BIT

(75) Inventors: Petrus Cornelis Kriesels, Ta Assen (NL); Djurre Hans Zijsling, GD Rijswijk (NL)

(73) Assignee: Shell Oil Company, Houston, TX (US)

( * ) Notice: Subject to any disclaimer, the term of this patent is extended or adjusted under 35 U.S.C. 154(b) by 113 days.

(21) Appl. No.: 10/432,698

(22) PCT Filed: Nov. 27, 2001

(86) PCT No.: PCT/EP01/14137

§ 371 (c)(1),
(2), (4) Date: Jul. 22, 2003

(87) PCT Pub. No.: WO02/42597

PCT Pub. Date: May 30, 2002

(65) Prior Publication Data

US 2004/0069540 A1 Apr. 15, 2004

(30) Foreign Application Priority Data

Nov. 27, 2002 (EP) ..... 00204198

(51) Int. Cl.[7] ..... E21B 10/60
(52) U.S. Cl. ..... 175/339; 175/417

(58) Field of Search ..... 175/65, 67, 339, 175/340, 417, 418, 431, 424

(56) References Cited

U.S. PATENT DOCUMENTS

| | | | | |
|---|---|---|---|---|
| 3,688,852 | A | 9/1972 | Gaylord et al. | |
| 4,494,618 | A * | 1/1985 | Radtke | 175/393 |
| 4,687,066 | A * | 8/1987 | Evans | 175/340 |
| 4,730,682 | A | 3/1988 | Ditzig | |
| 4,819,746 | A * | 4/1989 | Brown et al. | 175/296 |
| 5,794,725 | A * | 8/1998 | Trujillo et al. | 175/339 |
| 5,803,187 | A * | 9/1998 | Javins | 175/57 |
| 6,089,336 | A | 7/2000 | Nexton et al. | |

* cited by examiner

*Primary Examiner*—Frank S. Tsay

(57) ABSTRACT

A drill bit for drilling a borehole into an earth formation is provided. The drill bit has a central longitudinal axis and a bottom surface facing the borehole bottom during drilling with the drill bit, and comprises primary fluid injection means arranged at the bottom surface and located at a selected radial distance from the central longitudinal axis, the primary fluid injection means being arranged to eject a primary stream of fluid into the borehole, the primary stream having a component in a transverse plane of the drill bit, directed from the fluid injection means to the central longitudinal axis.

6 Claims, 3 Drawing Sheets

DRILL BIT

The present application claims priority on European Patent Application 00204198.6, filed on 27, Nov. 2000.

FIELD OF THE INVENTION

The present invention relates to a drill bit for drilling a borehole into an earth formation.

BACKGROUND OF THE INVENTION

Drill bits generally operate on the basis of a rotational action of cutting members against the borehole bottom. In many of the harder rock formations the rate of penetration of such rotary drill bits is relatively low. In hard rock formations improved results have been obtained with percussion drilling systems which operate on the basis of a combined rotational and hammering action of the bit against the borehole bottom. Such percussion bits generally have cutting members (for example of relatively large hemispherical shape) which predominantly have a downward crushing action. In view thereof drill cuttings of relatively small size are produced by the drill bit, which cuttings in a wet environment have an increased tendency of clogging of the bottom surface of the drill bit and the borehole bottom. Once the bottom surface of the drill bit has become clogged by a mass of wet drill cuttings (also referred to as bit balling) the drilling efficiency is significantly reduced.

SUMMARY OF THE INVENTION

It is therefore an object of the invention to provide a drill bit which has a reduced tendency of clogging of the bottom surface with drill cuttings.

In accordance with the invention there is provided a drill bit for drilling a borehole into an earth formation, the drill bit having a central longitudinal axis and a bottom surface facing the borehole bottom during drilling with the drill bit, the drill bit comprising primary fluid injection means arranged at the bottom surface and located at a selected radial distance from the central longitudinal axis, the primary fluid injection means being arranged to eject a primary stream of fluid into the borehole, the primary stream having a component in a transverse plane of the drill bit, directed from the fluid injection means to the central longitudinal axis.

The direction of the primary fluid injection means is such that said component of the primary stream is directed towards the central part of the bottom surface. As a result the central part of the bottom surface, which is most prone to clogging (e.g. due to the relatively low rotational velocity), is cleaned from drill cuttings.

Suitably the drill bit further comprises secondary fluid injection means arranged at the bottom surface and spaced from the primary fluid injection means, the secondary fluid injection means being arranged to eject a secondary stream of fluid into the borehole, the secondary stream having a component in said transverse plane, directed substantially opposite the direction of said component of the primary stream of fluid.

In this manner the streams flow in a cross-flow mode thereby ensuring that all parts of the bottom surface of the bit are adequately cleaned.

It is furthermore achieved that the borehole bottom is adequately cleaned from drill cuttings.

BRIEF DESCRIPTION OF THE DRAWINGS

The invention will now be described hereinafter in more detail and by way of example, with reference to the accompanying drawings in which the examples should not be construed to limit the scope of the invention.

In the Figures like reference signs relate to like components.

DETAILED DESCRIPTION OF THE PREFERRED EMBODIMENTS

Figure 1:
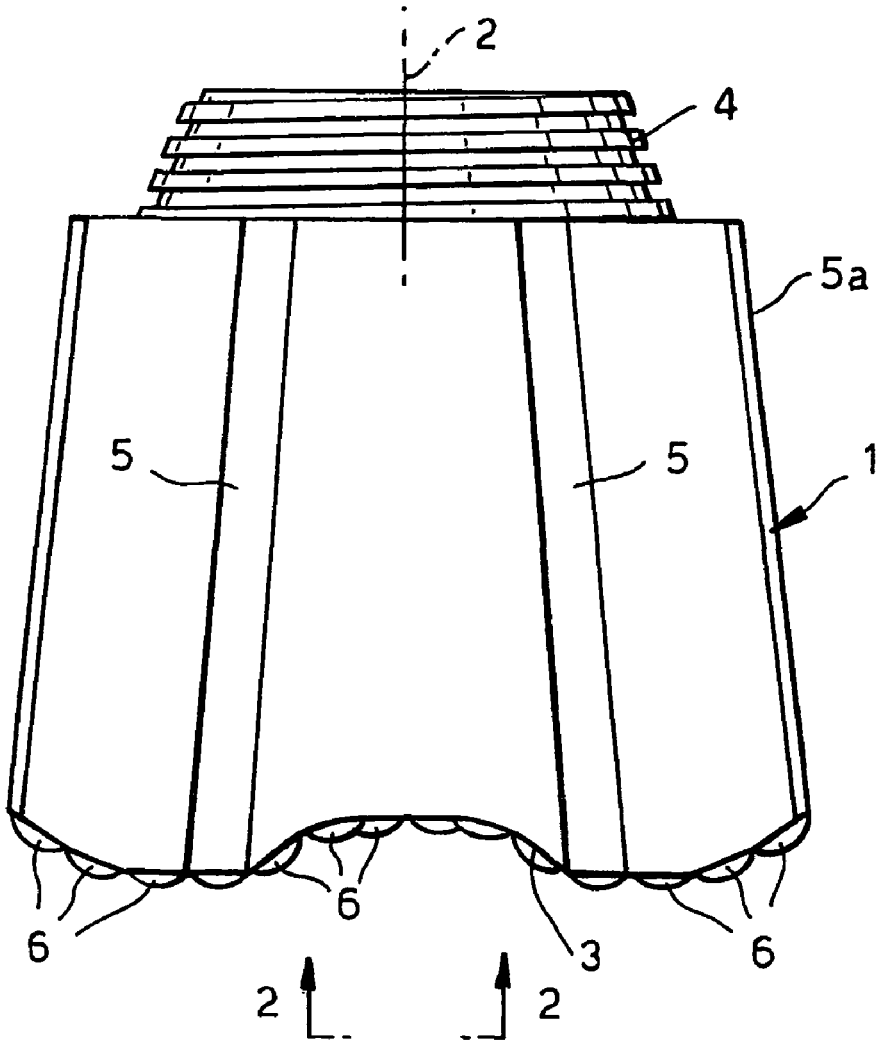
FIG. 1 schematically shows a side view of an embodiment of the drill bit according to the invention.
Figure 2:
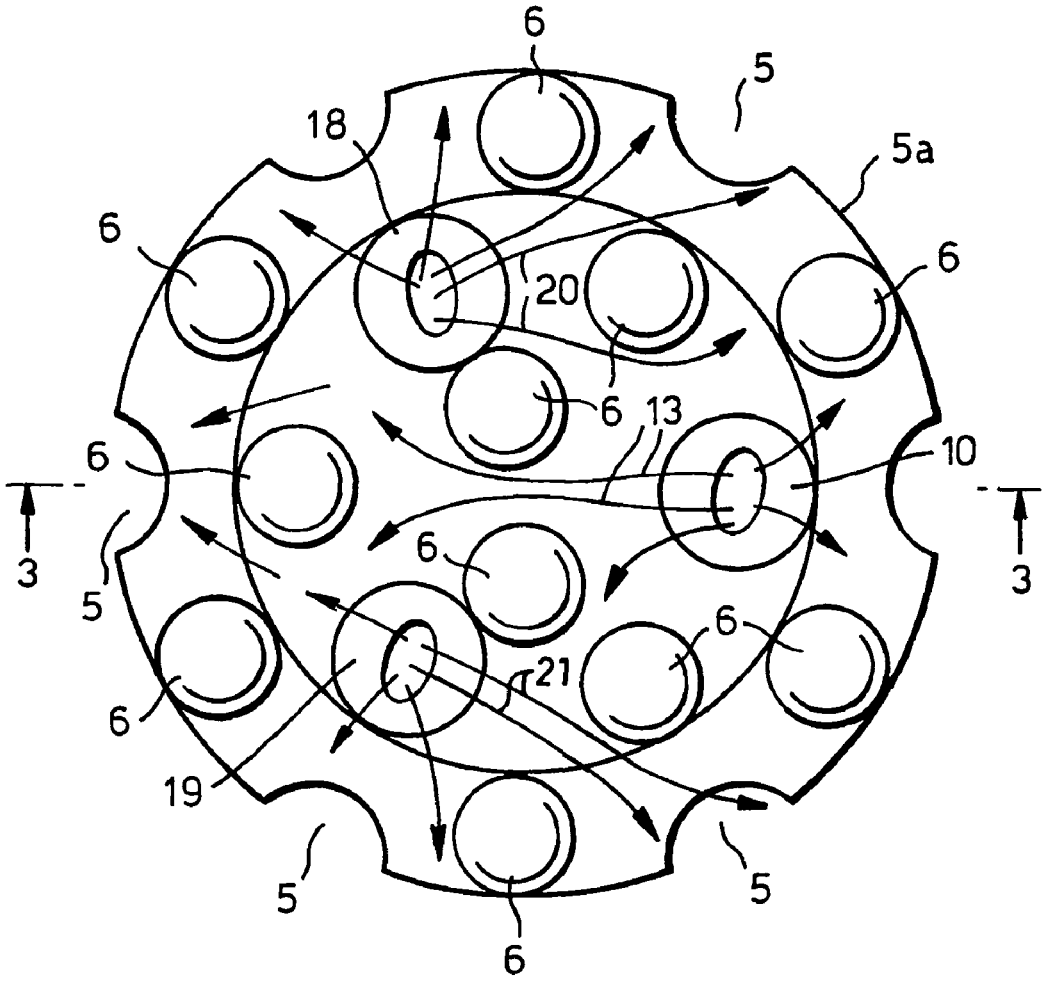
FIG. 2 schematically shows a bottom view of the drill bit of FIG. 1 (seen in the direction 2—2)

Referring to FIGS. 1 and 2 there is shown a percussion drill bit 1 for drilling of a borehole (not shown) into an earth formation, the drill bit 1 having a central longitudinal axis 2 and a bottom surface 3 facing the borehole bottom during drilling with the drill bit 1. A connector 4 for connecting the drill bit 1 to a drill string (not shown) is arranged at the upper end of the drill bit 1, and a plurality of drilling fluid channels extend in longitudinal direction in the form of recesses 5 formed in the gauge surface 5*a* of the drill bit 1. The bottom surface 3 is provided with a plurality of mutually spaced hemispherical cutting members 6.

Figure 3:
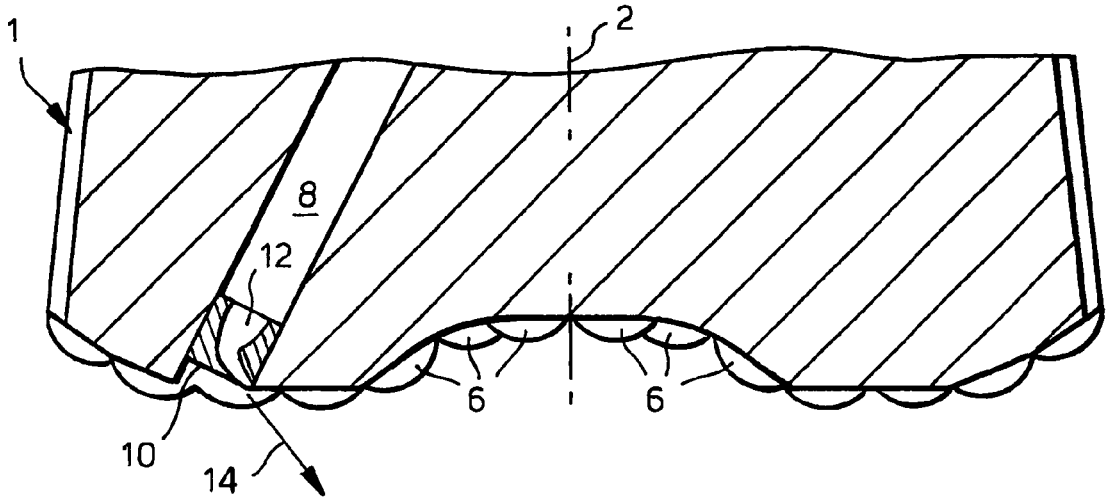
FIG. 3 schematically shows a longitudinal section along lines 3—3 in FIG. 2.

Referring further to FIG. 3, the drill bit 1 is internally provided with a fluid channel 8 which is in fluid communication with a drilling fluid conduit (not shown) of the drill string, which channel 8 is provided with a primary fluid injection means in the form of nozzle 10 located at a radial distance from the central longitudinal axis 2 and debauching at the bottom surface 3. The primary nozzle 10 has a bent fluid passage 12 so as to eject a primary stream 13 of fluid into the borehole in a direction 14 (FIG. 3) having a component in a transverse plane (not shown) of the drill bit 1, directed from the nozzle 10 to the central longitudinal axis 2.

The drill bit is further provided with two mutually spaced secondary fluid injection means in the form of nozzles 18, 19 (FIG. 2) arranged at a radial distance from the central longitudinal axis 2 and debauching at the bottom surface 3. Each secondary nozzle 18, 19 is arranged in a respective fluid channel (not shown) of the drill bit which is in fluid communication with the drilling fluid conduit of the drill string. Further, each secondary nozzle 18, 19 is directed so as to inject a secondary stream 20, 21 of fluid into the borehole in a direction having a component in said transverse plane, in a direction opposite the direction of said component of the primary stream of fluid.

Figure 4:
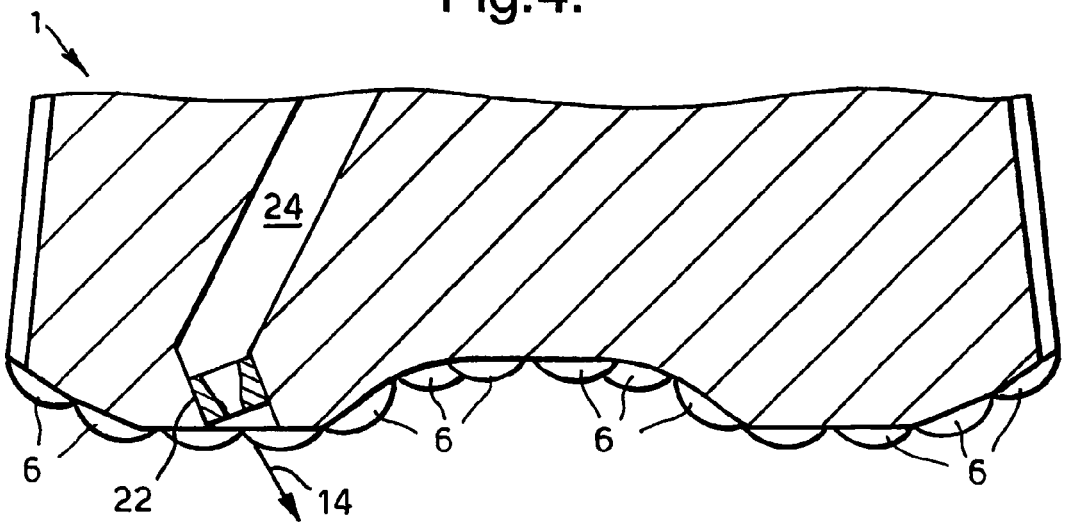
FIG. 4 schematically shows a longitudinal section of a lower end part of an alternative drill bit according to the invention.

In FIG. 4 is shown an alternative nozzle arrangement with nozzle 22 which can be applied instead of the bent nozzles 10, 18, 19 referred to above. The alternative nozzle 22 has a straight fluid passage 24 and is arranged in a bent fluid channel 26 so as to eject, during normal use, a stream of fluid into the borehole in the desired direction (for example direction 14).

During normal operation, the drill bit is connected to the lower end of the drill string by means of connector 4. The drill string is lowered in the borehole and operated in a percussion drilling mode whereby the bit is simultaneously rotated about central longitudinal axis 2 and translated so as to provide a hammering action on the borehole bottom. Due to the hammering action of the hemispherical cutting members 6 against the borehole bottom, drill cuttings of relatively small size are produced. Therefore, there will be an increased tendency of clogging of the bottom surface 3 with wet drill cuttings, when compared to drill bits which purely rely on a rotational action and not on a hammering action.

Simultaneously with the rotational and hammering movement of the drill bit 1, drilling fluid is pumped through the drill string and from there into the respective fluid channels and nozzles 10, 18, 19. As a result a primary fluid stream 13 and secondary fluid streams 20, 21 are ejected from the respective nozzles 10, 18, 19 into the space between the bottom surface 3 and the borehole bottom. Due to the directional arrangement of the nozzles 10, 18, 19, the streams 13, 18, 19 flow in a cross-flow mode whereby stream 13 flows towards the centre of the end surface 3, and streams 18, 19 flow in opposite direction to the stream 13 at both sides thereof. It is thereby achieved that the central part of the end surface 3 is predominantly cleaned from drill cuttings by the stream 13, and that the outer area of the bottom surface 13 is predominantly cleaned from drill cuttings by the streams 18, 19. Furthermore, the streams 13, 18, 19 also serve to efficiently clean the borehole bottom from drill cuttings.

Normal operation of the drill bit with the alternative nozzle arrangement shown in FIG. 4 is similar to normal operation of the drill bit shown in FIG. 3.

What is claimed is:

1. A drill bit for drilling a borehole into an earth formation, the drill bit having a central longitudinal axis and a bottom surface facing the borehole bottom during drilling with the drill bit, the drill bit comprising primary fluid injection means arranged at the bottom surface and located at a selected radial distance from the central longitudinal axis, the primary fluid injection means being arranged to eject a primary stream of fluid into the borehole, the primary stream having a component in a plane substantially transverse to the drill bit axis, directed from the fluid injection means to the central longitudinal axis, the drill bit further comprising secondary fluid injection means arranged at the bottom surface and spaced from the primary fluid injection means, the secondary fluid injection means being arranged to eject a secondary stream of fluid into the borehole, the secondary stream having a component in said transverse plane, directed substantially opposite the direction of said component of the primary stream of fluid in a cross flow mode.

2. The drill bit of claim 1, wherein the drill bit is provided with a plurality of mutually spaced said secondary fluid injection means.

3. The drill bit of claim 2, wherein the plurality of mutually spaced secondary fluid injection means are arranged to eject the secondary stream on both sides of the primary stream in operation.

4. The drill bit of claim 1, wherein operation there is essentially one primary stream.

5. The drill bit of claim 1, wherein each fluid injection means includes a fluid injection nozzle.

6. The drill bit of claim 1, wherein the drill bit is a percussion dill bit provided with a plurality of mutually spaced cutting elements arranged at said bottom surface.

* * * * *